US005611408A

United States Patent [19]

Abukhader

[11] Patent Number: 5,611,408

[45] Date of Patent: Mar. 18, 1997

[54] VEHICLE DISABLING DEVICE

[76] Inventor: Saleem A. Abukhader, 6401 Warner Ave., Apt. 572, Huntington Beach, Calif. 92647

[21] Appl. No.: 418,477

[22] Filed: Apr. 7, 1995

[51] Int. Cl.[6] ..... B60R 25/00

[52] U.S. Cl. ..... 180/287; 404/6

[58] Field of Search ..... 180/287; 404/6, 404/9; 56/400.06, 400.19, 400.2; 280/762, 727

[56] References Cited

U.S. PATENT DOCUMENTS

| | | | |
|---|---|---|---|
| 1,325,580 | 12/1919 | Reiter | 56/400.19 |
| 2,086,170 | 7/1937 | Muranaka | 56/400.19 |
| 2,353,386 | 7/1944 | Bourcier . | |
| 4,055,104 | 10/1977 | Osofsky et al. . | |
| 4,382,714 | 5/1983 | Hutchinson | 404/6 |
| 4,995,756 | 2/1991 | Kilgrow et al. | 404/6 |
| 5,243,894 | 9/1993 | Minovitch | 89/1.11 |
| 5,253,950 | 10/1993 | Kilgrow et al. | 404/6 |
| 5,311,733 | 5/1994 | Krenkel | 56/400.06 |
| 5,328,292 | 7/1994 | Williams | 404/6 |
| 5,330,285 | 7/1994 | Greves et al. | 404/6 |
| 5,482,397 | 1/1996 | Soleau | 404/6 |

*Primary Examiner*—Paul N. Dickson
*Attorney, Agent, or Firm*—Richard C. Litman

[57] ABSTRACT

A device for remotely disabling a vehicle by deflation of the vehicle's tires is provided. The device is mounted on an underside of a law enforcement agent's chase vehicle. A laser light in the device indicates to the agent where a projectile expelled by the device will pass. The device is operated by directing the laser light at an underside of a chased vehicle and causing the device to expel the projectile. When the projectile is so expelled, it extends numerous spikes which destroy and deflate the chased vehicle's tires, thereby disabling the chased vehicle and preventing harm to innocent bystanders.

14 Claims, 4 Drawing Sheets

VEHICLE DISABLING DEVICE

BACKGROUND OF THE INVENTION

1. Field of the Invention

The present invention relates generally to vehicle barriers, and more specifically to devices for remotely preventing car movement.

2. Description of the Prior Art

High-speed vehicular police chases of criminal suspects can, needless to say, result in harm to innocent bystanders, especially in densely populated urban areas. For this reason and for the sake of apprehending a fleeing criminal, it is highly desirable to stop such chases before unnecessary harm can result. Because a police car chasing a criminal suspect's vehicle is necessarily some distance from that vehicle, an effective device for stopping the suspect's vehicle must operate remotely from that vehicle. While most police carry remotely operating projectile weapons, in the form of guns, these guns can be ineffective in stopping continued movement of a vehicle. Guns typically carried by police are designed to stop movement of people rather than vehicles, and are not suitable for use in stopping a chased vehicle. What is needed is a device that will accurately and effectively disable a fleeing vehicle. The device should be usable regardless of the path that the fleeing vehicle takes. Numerous efforts have been made in these regards, yet nothing prior to the present invention meets the clear need for a remote device for disabling a fleeing vehicle.

U.S. Pat. No. 2,353,386, issued on Jul. 11, 1944, to Charles D. Bourcier, describes a device for deflating pneumatic tires. The device acts by passively providing a conduit between the inside space of such a tire and the environment. There is no projectile and no laser aiming or guiding.

U.S. Pat. No. 4,055,104, issued on Oct. 25, 1977, to Irving B. Osofsky et al., describes a tire-piercing device which is intended to be imbedded in a paved surface. There is no projectile and no laser aiming or guiding.

U.S. Pat. No. 4,382,714, issued on May 10, 1983, to Walter G. Hutchison, describes a passive device for deflating pneumatic tires by providing a conduit between the inside space of such a tire and the environment. The device may be interconnected with similar devices, which are together placed on pavement where a vehicle is expected to pass. There is no projectile and no laser aiming or guiding.

U.S. Pat. No. 4,995,756, issued on Feb. 26, 1991, to Donald C. Kilgrow et al., describes a tire deflator with a supporting base that supports and then releases puncturing conduits once such conduits are imbedded in tires. There is no projectile and no laser aiming or guiding.

U.S. Pat. No. 5,243,894, issued on Sep. 14, 1993, to Michael A. Minovitch, describes a blinding light intended to immobilize assailants. The light is not used to guide or aim a projectile.

U.S. Pat. No. 5,253,950, issued on Oct. 19, 1993, to Donald C. Kilgrow et al., describes a foldable tire deflator. There is no projectile and no laser aiming or guiding.

U.S. Pat. No. 5,328,292, issued on Jul. 12, 1994, to Francis R. Williams, describes a tire-puncturing traffic barrier chain. There is no projectile and no laser aiming or guiding.

U.S. Pat. No. 5,330,285, issued on Jul. 19, 1994, to Kenneth J. Greves et al., describes an apparatus for deflating tires that is collapsible. It is to be placed in front of cars. There is no projectile and no laser aiming or guiding.

All of the above patents are drawn to devices useful for deflating tires of a vehicle following a known path, and are useless in high-speed vehicle chases in which the path of a chased vehicle cannot be predicted. None of the above inventions and patents, taken either singly or in combination, is seen to describe the instant invention as claimed.

SUMMARY OF THE INVENTION

By the present invention, a device for remotely disabling a vehicle by deflation of the vehicle's tires is provided. The device is mounted on an underside of a law enforcement agent's chase vehicle. A laser light in the device indicates to the agent where a projectile expelled by the device will pass. The device is operated by directing the laser light at an underside of a chased vehicle and by causing the device to expel the projectile. When the projectile is so expelled, it extends numerous spikes which destroy the integrity of the chased vehicle's tires, deflating the tires and thereby disabling the chased vehicle and preventing harm to innocent bystanders.

Accordingly, it is a principal object of the invention to disable a vehicle having tires.

It is another object of the invention to provide disablement of vehicles from remote locations.

It is a further object of the invention to ensure accuracy through use of laser aiming light.

Still another object of the invention is to prevent harm to innocent bystanders as a result of a high-speed vehicle chase.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

When high-speed automobile chases occur, there is a risk of harm to innocent bystanders stemming from reckless driving. Moreover, the chased automobile in such a chase must be stopped to apprehend the fleeing driver. For these reasons, it is highly desirable to provide a device that law enforcement officials can use to stop a chased automobile, while it is being chased. Because a path of a chased vehicle cannot generally be predicted, a mere stationary blockade cannot provide the desired effect of stopping a chased automobile. Instead, the present invention provides a device that can destroy an automobile's tires, thereby disabling it, even when the automobile is a substantial distance from the device's initial position. This remote effect is accomplished by providing an automatically deploying, tire-puncturing projectile.

Figure 1:
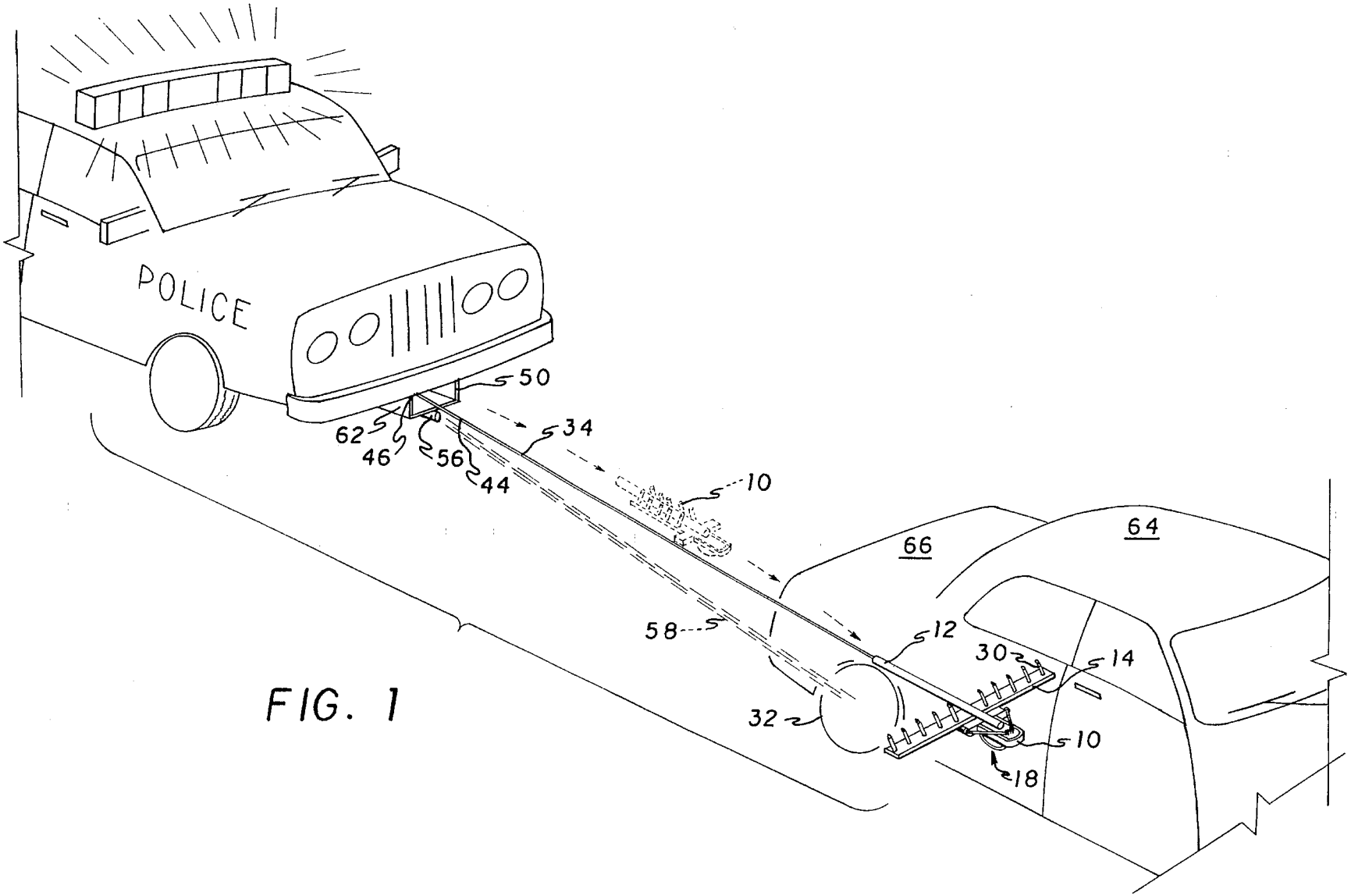
FIG. 1 is an environmental, perspective view of the vehicle-disabling device according to the present invention, subsequent to projection of the device.
Figure 2:
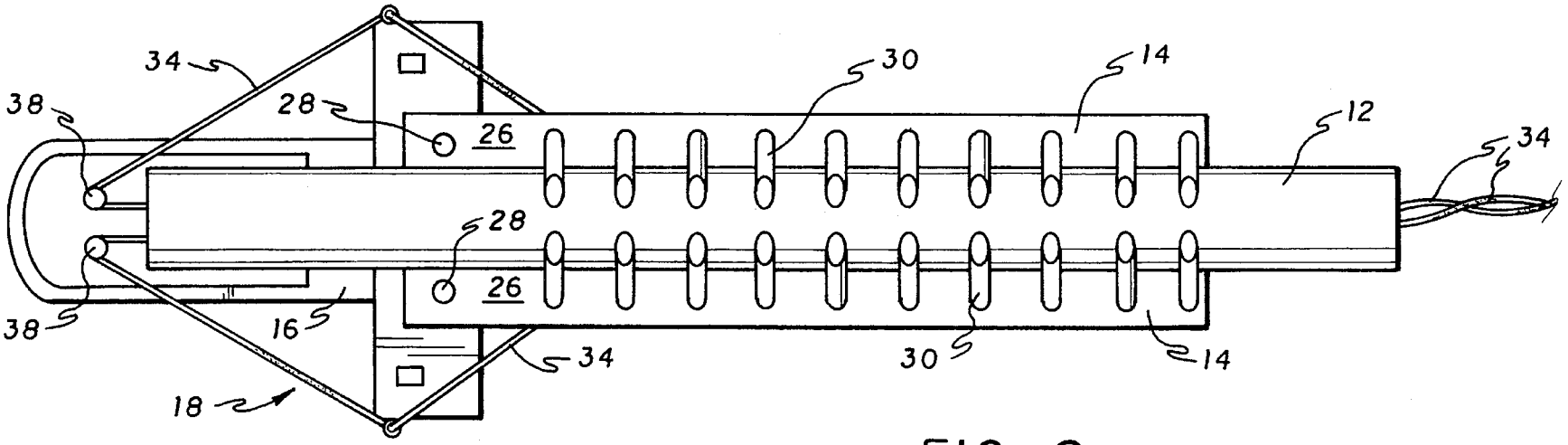
FIG. 2 is a top view of the vehicle disabling device according to the present invention in a closed configuration.
Figure 3:
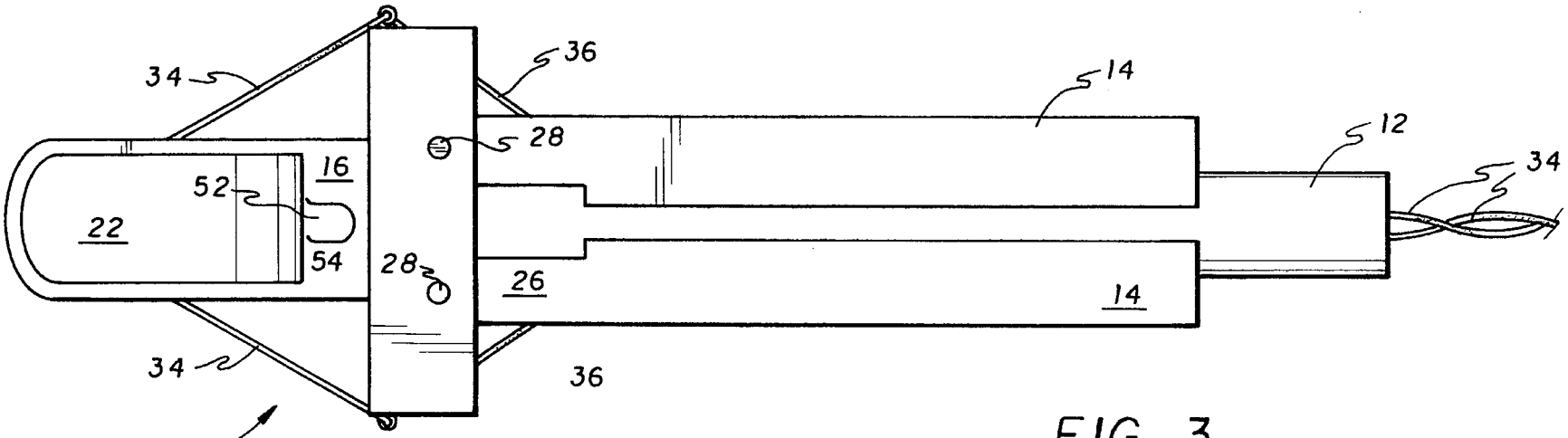
FIG. 3 is a bottom view of the vehicle disabling device according to the present invention in a closed configuration.
Figure 4:
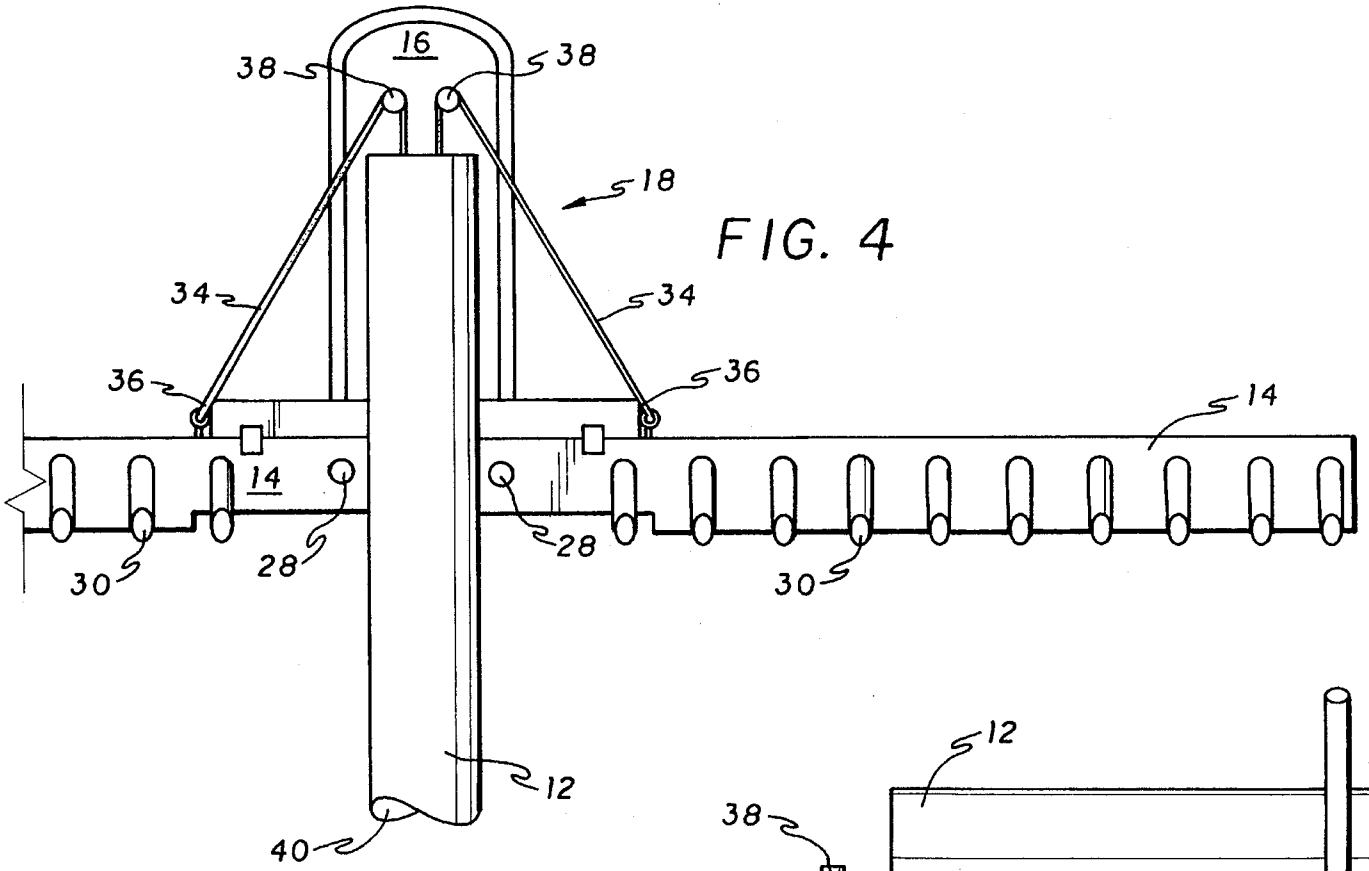
FIG. 4 is a top view of the vehicle disabling device according to the present invention in an open configuration.
Figure 5:
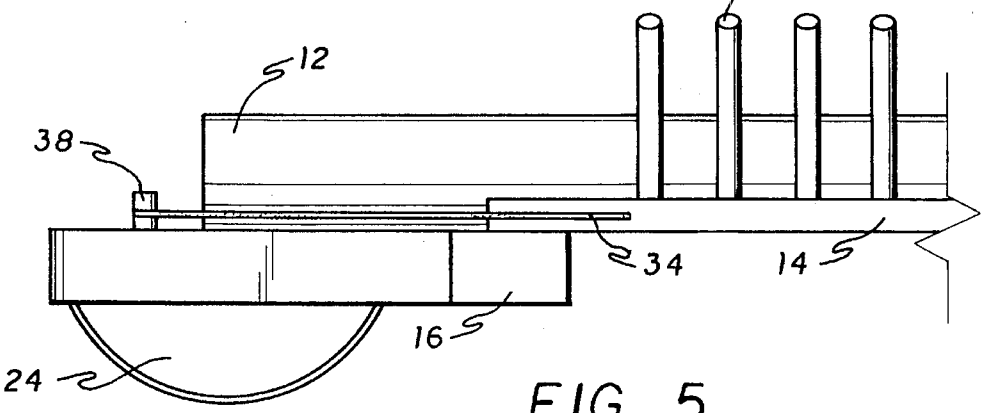
FIG. 5 is a detail side view of a front end of the present invention showing a shock-absorbing and friction-reducing member.
Figure 6:
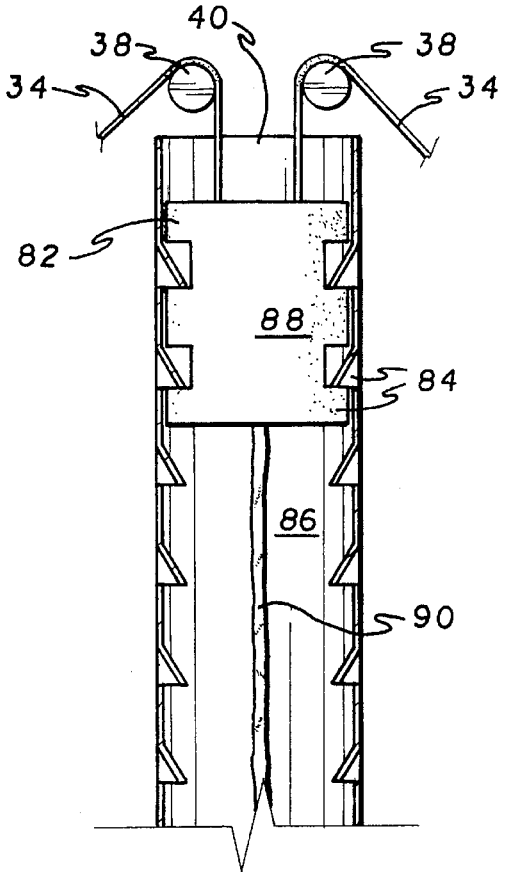
FIG. 6 is a cutaway view showing a mechanism for preventing undesired closure of open arms of the present invention.

Referring to the drawings, the vehicle disabling device 10 of the present invention has an elongated, hollow central body portion 12, elongated arms 14 pivotally connected to a front end 16 of the central body portion 12, and a deploying mechanism 18 that extends the arms 14 from a closed configuration in alignment with the central body portion 12, as shown in FIGS. 2 and 3, to an extended, T-shaped configuration at right angles with the central body portion 12, as shown in FIG. 4.

On a bottom side 20 of the front end 16 of the central body portion 12, there is a shock-absorbing and friction-reducing member 22. This shock-absorbing and friction-reducing member 22 is constructed of a flexible, resilient material, such as rubber, and impregnated by known means with a low-friction material, such as graphite. Alternately, this member 22 could be constructed of a single material having properties of resiliency and low-friction. This shock-absorbing and friction-reducing member 22 is curved in such a way as to form a hollow region 24 between much of the shock-absorbing and friction-reducing member 22 and the central body portion 12. In this way, the shock-absorbing and friction-reducing member 22 can flex without being obstructed by the central body portion 12.

The arms 14 are connected at first ends 26 to the front end 16 of the central body portion 12 by pivot joints 28. The arms 14 rotate in a ninety-degree arc, from a closed configuration parallel with the central body portion 12, as in FIGS. 2 and 3, to an open configuration perpendicular to the central body portion 12, as in FIG. 4. Preferably, means are employed to ensure that such rotation occurs only from a closed configuration to an open configuration. As one example, there are latches 80 of known type on the central body portion 12 that maintain the arms 14 in a pivotally extended, open configuration, until the latches 80 are released for re-use of the vehicle disabling device 10. As another example, there is a cylindrical anchor member 82 within a lumen 40 of the central body portion 12. As the arms 14 are moved into an open configuration, the anchor member 82 is forced away from the front end 16 of the central body portion 12. Such movement is irreversible because of teeth-and-notch portions 84 disposed along an interior surface 86 of the lumen 40 and an exterior surface 88 of the anchor member 82. These teeth-and-notch portions 84 allow movement of the anchor member 82 away from the forward end 16 of the central body portion 12, but not toward the forward end 16 of the central body portion 12. Because opening and closing of the arms 14 is directly related the position of the anchor member 82, the anchor member 82 ensures that opening of the arms 14 is irreversible.

Figure 7:
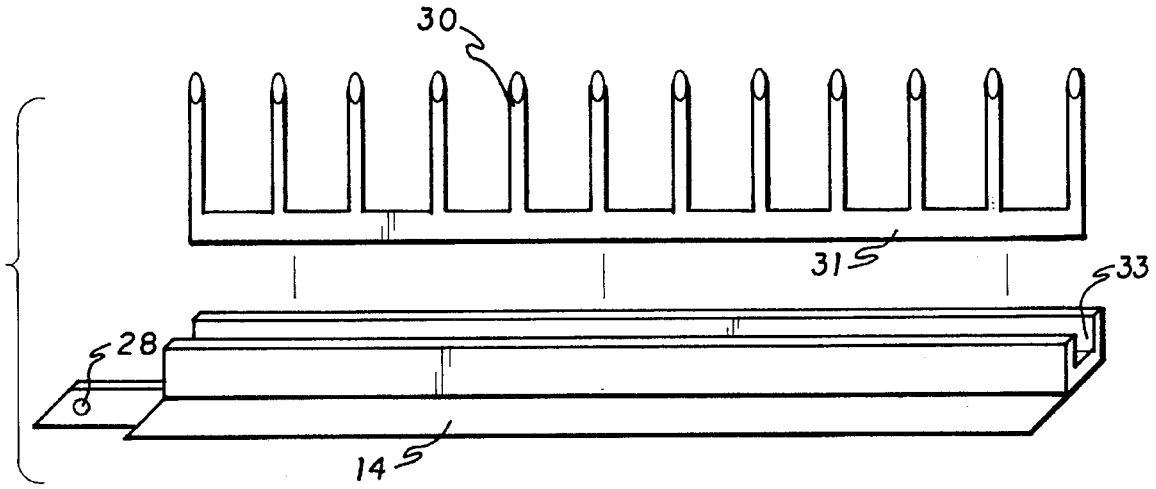
FIG. 7 is a partial, exploded view of an arm of one embodiment of the present invention, showing the optional detachable nature of spikes on the arm.

Disposed along the arms 14 are hollow spikes 30 through which gaseous matter can freely pass. The arms 14 and spikes 30 are constructed of a sturdy material that preferably has a light weight relative to the central body portion 12. When the vehicle disabling device 10 is in an open configuration, these spikes 30 point upward and rearward, relative to a typical projected path of the vehicle disabling device 10. The spikes 30 are thus oriented so that they are likely to bring about puncturing when a pressurized container, such as a tire 32, is impaled by the spikes 30, as by running over the spikes 30 when the vehicle disabling device 10 is lying open on a road surface. As shown in FIG. 7, these spikes 30 are preferably integral with an elongated member 31 which is insertable into and detachable from a slot 33 in arms 14, in such a way that if the spikes 30 are hit once, they will detach and lie flat. This result renders the spikes 30 harmless, and prevents puncturing of tires that subsequently run over the spikes 30.

The deploying mechanism 18 has dual cords 34, i.e., one for each arm 14. The cords 34 connect at first ends 36 of the cords 34 to the arms 14 at central points along the arms 14, through eyelets 13, pass around pulley members 38 at the front end of the central body portion 12, and then run through the lumen 40 of the central body portion 12. The cords 34 exit the central body portion 12 at a rear end 42 of the central body portion 12, and second ends 44 of the cords 34 are anchored at an anchor location 46 separate from the vehicle disabling device 10. Pulling of a second end 44 or second ends 44 of the cords 34 pivotally extends the arms 14 from a closed configuration in alignment with the central body portion 12 to an extended configuration at right angles with the central body portion 12. If the anchor member 82 is used, the dual cords 34 attach to the anchor member 82, instead of the anchor location 46. An anchor cord 90 then connects the anchor member 82 to the anchor location 46. Pulling of the anchor cord 90 pulls the anchor member 82, which in turn pulls the dual cords 34.

The vehicle disabling device 10, prior to use, is releasably mounted underneath a vehicle 48, preferably on a sliding track 50 of known type. A slug-like projection 52 on a bottom side 54 of the vehicle disabling device 10 ensures engagement with the sliding track 50. In this way, the vehicle disabling device 10 slides along the sliding track 50 and thereby develops directional momentum, in the direction of the sliding. The vehicle disabling device 10 is unobstructively releasable from the sliding track 50 so that the vehicle disabling device 10 can, when released from the sliding track 50, continue in its sliding path, even though separate from the sliding track 50. To avoid complications related to construction and maintenance, the sliding track 50 is preferably affixed to the vehicle 48 in such a way that the orientation of the sliding track 50 is controlled only by varying the orientation of the entire vehicle 48. Alternately, a known steering mechanism (not shown) could be used for controlling the orientation of the sliding track 50.

To ensure accurate orientation of the sliding track 50, there is a laser-light producing mechanism 56 of known type mounted alongside the sliding track 50. The laser-light producing mechanism 56 directs a beam of light 58 in the direction in which the sliding track 50 is oriented. As a result, the laser-light producing mechanism 56 produces an indicator light 60 at a point near or somewhat behind where the vehicle disabling device 10 will land after being projected, thus indicating the trajectory of the vehicle disabling device 10.

There is a projection mechanism 62 that, when triggered, projects the vehicle disabling device 10. This projection mechanism 62 preferably employs an explosive charge by known means to project the vehicle disabling device 10 in the direction of the indicator light 60, at a speed substantially greater than a typical speed of a chased vehicle. Alternately, a spring-actuated mechanism (not shown) could be employed. Activation of the projection mechanism 62 is preferably accomplished by an electronic activation switch (not shown) of known type, located within a passenger compartment of the vehicle 48 on which the vehicle disabling device 10 is mounted.

In use, the vehicle disabling device 10, while mounted on a law enforcement agent's vehicle 48, is aimed at a rear end 66 of a fleeing vehicle 64. Aiming is preferably accomplished by directing the law enforcement agent's vehicle 48 such that the indicator light 60 is directed underneath the fleeing vehicle 64, between its tires 32. If there is a steering mechanism for controlling the orientation of the sliding track, then this steering mechanism can also be used to direct the indicator light 60 to the desired location underneath the fleeing vehicle 64. When the indicator light 60 is correctly positioned, a law enforcement agent closes the activation switch, thereby causing the projection mechanism 62 to project the vehicle disabling device 10 in the direction of the indicator light 60. Preferably, the vehicle disabling device 10 is thus projected with sufficient force so as to travel well beyond the location indicated by the indicator light 60, relative to the surface on which the fleeing vehicle 64 is traveling. However, the vehicle disabling 10 will land at approximately the location indicated by the indicator light 60, relative to the fleeing vehicle 64 itself, at the time the vehicle disabling device 10 is projected. The shock-absorbing and friction-reducing member 22 absorbs much landing impact and allows the vehicle disabling device 10 to slide underneath the fleeing vehicle 64. In this way, the vehicle disabling device 10 travels beyond the path of the fleeing vehicle's tires 32. Because the cords 34 are of finite length, continued travelling of the vehicle disabling device 10 subsequent to projection by the projection mechanism 62 resulting in development of tension in the cords 34. Development of this tension can be accelerated by slowing of the vehicle 48, immediately subsequent to projection of the vehicle disabling device 10. This tension pulls the cords 34, resulting in extension of the arms 14 so that the vehicle disabling device develops a T-shaped configuration, as shown in FIG. 4. In this configuration, the spikes 30 are oriented toward oncoming tires 32. When the tires 32 roll over the spikes 30, the tires 32 become punctured. Because the spikes 30 are hollow, pressurized gas in the tires 32 passes through the spikes 30 and out of the tires. In this way, the tires are deflated and the fleeing vehicle 64 is disabled. By this use of the vehicle disabling device 10 of the present invention, a fleeing vehicle 64 is disabled from a remote location, even without anyone knowing in advance the path that the fleeing vehicle 64 will take.

It is to be understood that the present invention is not limited to the sole embodiment described above, but encompasses any and all embodiments within the scope of the following claims.

I claim:

1. A vehicle disabling device comprising:

an elongated central body having a forward end and a rear end;

an elongated first arm and an elongated second arm, each of said arms having a first end and a second end, said first end of said first arm and said first end of said second arm being connected pivotally to said body at said forward end; and a plurality of spikes disposed along said arms, wherein said spikes are sharp and hollow, whereby puncture of a tire by said spikes allows free passage of air between regions inside the tire and regions outside the tire.

2. The vehicle disabling device according to claim 1, further including means for mounting said vehicle disabling device on an underside of a vehicle, a projection mechanism for projecting said vehicle disabling device from the vehicle, and means for pivotally extending said arms away from said body, whereby full pivotal extension results in said arms and said body having a T-shaped configuration.

3. The vehicle disabling device according to claim 2, wherein said means for extending said arms comprises:

a first cord connected to said first arm at said second end of said first arm; and a second cord connected to said second arm at said second end of said second arm;

said first and second cords being dimensioned and configured so that pulling of said first and second cords causes full extension of said arms.

4. The vehicle disabling device according to claim 3, wherein:

said central body is hollow;

said cords pass from said arms to said forward end of said central body, through said central body, out of said central body at said rear end, and attach to the vehicle; whereby when the vehicle disabling device is projected from the vehicle, the vehicle disabling device travels away from the vehicle until said cords prevent further travel of the vehicle disabling device and pulling of said cords results.

5. The vehicle disabling device according to claim 3, wherein:

said central body is hollow, said central body having a cylindrical anchor member disposed therein and movable within said central body;

said cords pass from said arms to said forward end of said central body, through said central body, and attach to said anchor member, said anchor member having an anchor cord attached thereto, said anchor cord passing out of said central body at said rear end and attaching to the vehicle; whereby when the vehicle disabling device is projected from the vehicle, the vehicle disabling device travels away from the vehicle until said anchor cord prevents further travel of the vehicle disabling device and pulling of said cords results.

6. The vehicle disabling device according to claim 5, further including means for ensuring that said anchor member only moves away from said forward end of said central body and towards said rear end of said central body.

7. The vehicle disabling device according to claim 2, further including latches that reversibly maintain full pivotal extension of said arms.

8. The vehicle disabling device according to claim 2, wherein said means for mounting the vehicle disabling device comprises a sliding track which the vehicle disabling device travels on, and then disengages from, when the vehicle disabling device is projected.

9. The vehicle disabling device according to claim 1, wherein said spikes detach from said arms upon impact of a tire upon said arms, whereby said spikes become incapable of causing puncture of tires upon detaching from said arms.

10. The vehicle disabling device according to claim 2, further including means for indicating trajectory of the vehicle disabling device when the vehicle disabling device is projected.

11. The vehicle disabling device according to claim 10, wherein said means for indicating trajectory of the vehicle disabling device is a laser light dimensioned and configured to provide a visible mark indicating a direction in which the vehicle disabling device will travel when projected.

12. The vehicle disabling device according to claim 1, further including a shock-absorbing and friction-reducing member disposed on a bottom surface of said central body.

13. A vehicle disabling device comprising:

an elongated central body having a forward end and a rear end;

an elongated first arm and an elongated second arm, each of said arms having a first end and a second end, said first end of said first arm and said first end of said second arm being connected pivotally to said body at said forward end;

a plurality of spikes disposed along said arms;

means for mounting said vehicle disabling device on an underside of a vehicle;

a projection mechanism for projecting said vehicle disabling device from the vehicle; and means for indicating trajectory of said vehicle disabling device when said vehicle disabling device is projected.

14. A vehicle disabling device comprising:

an elongated central body having a forward end and a rear end, said central body being hollow;

an elongated first arm and an elongated second arm, each of said arms having a first end and a second end, said first end of said first arm and said first end of said second arm being connected pivotally to said body at said forward end;

a plurality of spikes disposed along said arms;

means for mounting said vehicle disabling device on an underside of a vehicle;

a projection mechanism for projecting said vehicle disabling device from the vehicle; and means for pivotally extending said arms away from said body, wherein full pivotal extension results in said arms and said body having a T-shaped configuration, said means for extending said arms including:

a first cord connected to said first arm at said second end of said first arm; and a second cord connected to said second arm at said second end of said second arm;

said first and second cords being dimensioned and configured so that pulling of said first and second cords causes full extension of said arms, wherein said cords pass from said arms to said forward end of said central body, through said central body, out of said central body at said rear end, and attach to the vehicle; whereby when said vehicle disabling device is projected from the vehicle, said vehicle disabling device travels away from the vehicle until said cords prevent further travel of said vehicle disabling device and pulling of said cords results.

* * * * *